US006452136B1

(12) United States Patent
Berkcan et al.

(10) Patent No.: US 6,452,136 B1
(45) Date of Patent: Sep. 17, 2002

(54) MONITORING AND CONTROL SYSTEM AND METHOD FOR SENSING OF A VESSEL AND OTHER PROPERTIES OF A COOKTOP

(75) Inventors: Ertugrul Berkcan, Niskayuna, NY (US); Emilie Thorbjorg Saulnier, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/734,873

(22) Filed: Dec. 13, 2000

(51) Int. Cl.[7] ..... H05B 1/02

(52) U.S. Cl. ..... 219/502; 219/518; 219/497; 219/448.1; 250/338.3

(58) Field of Search ..... 219/446.1, 445.1, 219/448.4, 460.1, 518, 497, 494; 250/338.1, 338.3, 339.06, 339.11, 341.7

(56) References Cited

U.S. PATENT DOCUMENTS

| | | | | |
|---|---|---|---|---|
| 3,710,076 | A | | 1/1973 | Frazier |
| 3,887,471 | A | | 6/1975 | Stotlar |
| 4,578,584 | A | | 3/1986 | Baumann et al. |
| 4,647,776 | A | | 3/1987 | Kern et al. |
| 4,730,940 | A | | 3/1988 | Herber et al. |
| 4,740,664 | A | | 4/1988 | Payne et al. |
| 4,932,749 | A | | 6/1990 | Haidle et al. |
| 5,001,328 | A | * | 3/1991 | Schreder et al. ..... 219/449 |
| 5,126,536 | A | | 6/1992 | Devlin |
| 5,138,135 | A | | 8/1992 | Husslein et al. |
| 5,180,226 | A | | 1/1993 | Moslehi |
| 5,227,610 | A | | 7/1993 | Schultheis et al. |
| 5,231,595 | A | | 7/1993 | Makino et al. |
| 5,243,172 | A | | 9/1993 | Hazan et al. |
| 5,249,142 | A | | 9/1993 | Shirakawa et al. |
| 5,319,202 | A | | 6/1994 | Pompei |
| 5,389,764 | A | | 2/1995 | Nishii et al. |
| 5,424,512 | A | | 6/1995 | Turetta et al. |
| 5,430,427 | A | | 7/1995 | Newman et al. |
| 5,488,214 | A | | 1/1996 | Fettig et al. |
| 5,528,041 | A | | 6/1996 | Pompei |
| 5,709,473 | A | | 1/1998 | Sultan et al. |
| 5,893,996 | A | | 4/1999 | Gross et al. |
| 5,900,174 | A | | 5/1999 | Scott |
| 6,111,228 | A | | 8/2000 | Berkcan et al. |
| 6,140,617 | A | | 10/2000 | Berkcan et al. |

* cited by examiner

*Primary Examiner*—Mark Paschall
(74) *Attorney, Agent, or Firm*—John F. Thompson; Jill M. Breedlove

(57) ABSTRACT

An apparatus that determines properties of a cooktop is provided. The cooktop includes a cooktop surface and a vessel that is selectively placed on the cooktop surface. The apparatus comprises a radiation sensor positioned below the cooktop surface. The radiation sensor senses at least a portion of, at least one of reflected radiation and ambient radiation that are provided above the cooktop surface and that pass through the cooktop surface. The radiation sensor also generates a detected radiation signal based on the sensed radiation. A processor is connected to the radiation sensor, and the processor determines properties of the cooktop from analyzing the detected radiation signal.

41 Claims, 3 Drawing Sheets

MONITORING AND CONTROL SYSTEM AND METHOD FOR SENSING OF A VESSEL AND OTHER PROPERTIES OF A COOKTOP

BACKGROUND OF THE INVENTION

The present invention relates to a monitoring and control system for sensing the presence and/or absence of a vessel on a cooktop and other properties of the cooktop, and more specifically, the present invention relates to sensing various properties of a cooktop independent of the reflectivity of the vessel to gather the information.

In some conventional cooktops or ranges, the reflective properties of a vessel positioned on the surface of the cooktop are used to determine states and/or other properties of the cooktop, vessel or cooking process. However, the reflective properties vary between vessels. In addition, with age and usage of the vessel, the reflective properties of the vessel can diminish due to for example corrosion, staining and burned on coatings. Thus, the use of vessel reflective properties to determine the states and/or other properties of the cooktop, vessel or cooking process may, at times, be unreliable or inconsistent. Therefore, it is desired to have a cooktop and/or range that uses a system that is not dependent upon the reflective properties of the vessel when determining states and/or characteristics of the cooktop, vessel or cooking process.

As described above, in some conventional cooktops or ranges, the determination of the states and/or other properties of the cooktop, vessel or cooking process can be dependent upon the signals that are reflected from the vessel and detected by the sensor. As such, the reflectivity of the vessel is directly related to the amount of reflected signals that are detected by the sensor. Therefore, a decrease in the reflective properties of the vessel decreases the amount of reflected signals and, thus, directly affects the determination of the states and/or other properties of the cooktop, vessel or the cooking process. For example, the presence of a vessel on the cooktop can be detected when a greater amount of signals are reflected and/or detected as compared to the amount of signals reflected and/or detected when the vessel is not present on the cooktop. In one example, a vessel having very poor reflective qualities can be placed on the cooktop and the sensor system of the cooktop and/or range may not be able to determine if the vessel is present on the cooktop due to the poor reflective qualities of the vessel.

So that problems associated with overheating the cooktop surface are avoided, some modern cooktop and/or range controllers are programmed to heat the cooktop or range only when a vessel is present. When a cooktop or range sensor system is unable to detect the presence of a vessel having poor reflective properties, a user may become dissatisfied when the cooktop or range does not heat when the vessel is placed on the cooktop. The user may be further dissatisfied when an old vessel must be replaced with a new vessel having better reflective properties. Thus, it is desired to have a cooktop and/or range that detects the presence, absence or other properties of a vessel on the cooktop that is independent from the reflective properties of the vessel.

BRIEF SUMMARY OF THE INVENTION

In one exemplary embodiment, an apparatus for determining properties of a cooktop is provided. The cooktop includes a cooktop surface and a vessel selectively placed on the cooktop surface. The apparatus comprises a radiation source positioned below the cooktop surface. The radiation source generates radiation and transmits the radiation through the cooktop surface to a position above the cooktop surface. A reflective surface is positioned above the cooktop surface and reflects at least a portion of the transmitted radiation. A radiation sensor is positioned below the cooktop surface and sensing at least a portion of the reflected radiation that passes through the cooktop surface. The radiation sensor also generates a detected radiation signal in response to the sensed radiation. A processor is connected to the radiation sensor and receives the detected radiation signal, and the processor determines properties of the cooktop from analyzing the detected radiation signal.

In another exemplary embodiment, a method for detecting properties of a cooktop is provided. The cooktop includes a cooktop surface and a vessel selectively placed on the cooktop surface. The method comprises the steps of generating radiation at a position below the cooktop surface. The generated radiation is transmitted through the cooktop surface to a position above the cooktop surface. At least a portion of the transmitted radiation is reflected toward the cooktop surface using a reflective member. A portion of the reflected radiation passing through the cooktop surface is detected. Properties of the cooktop are determined from the detected radiation.

BRIEF DESCRIPTION OF THE DRAWINGS

FIG. 2 FIG. 1 is a cross-sectional and block diagram view of one another exemplary embodiment of a cooktop monitoring and control system;

DETAILED DESCRIPTION OF THE INVENTION

Figure 1:
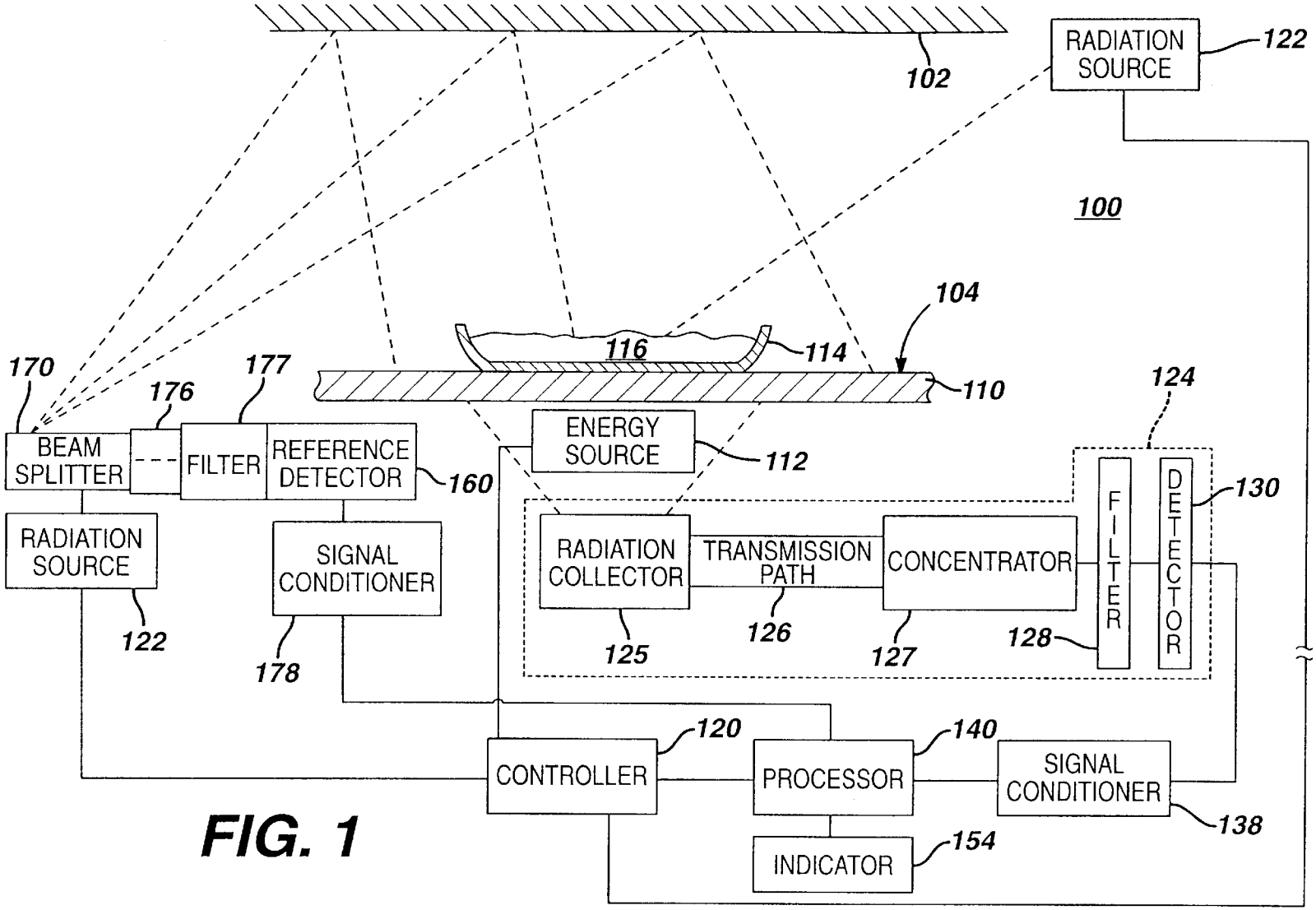
FIG. 1 is a cross-sectional and block diagram view of one exemplary embodiment of a cooktop monitoring and control system.
Figure 2:
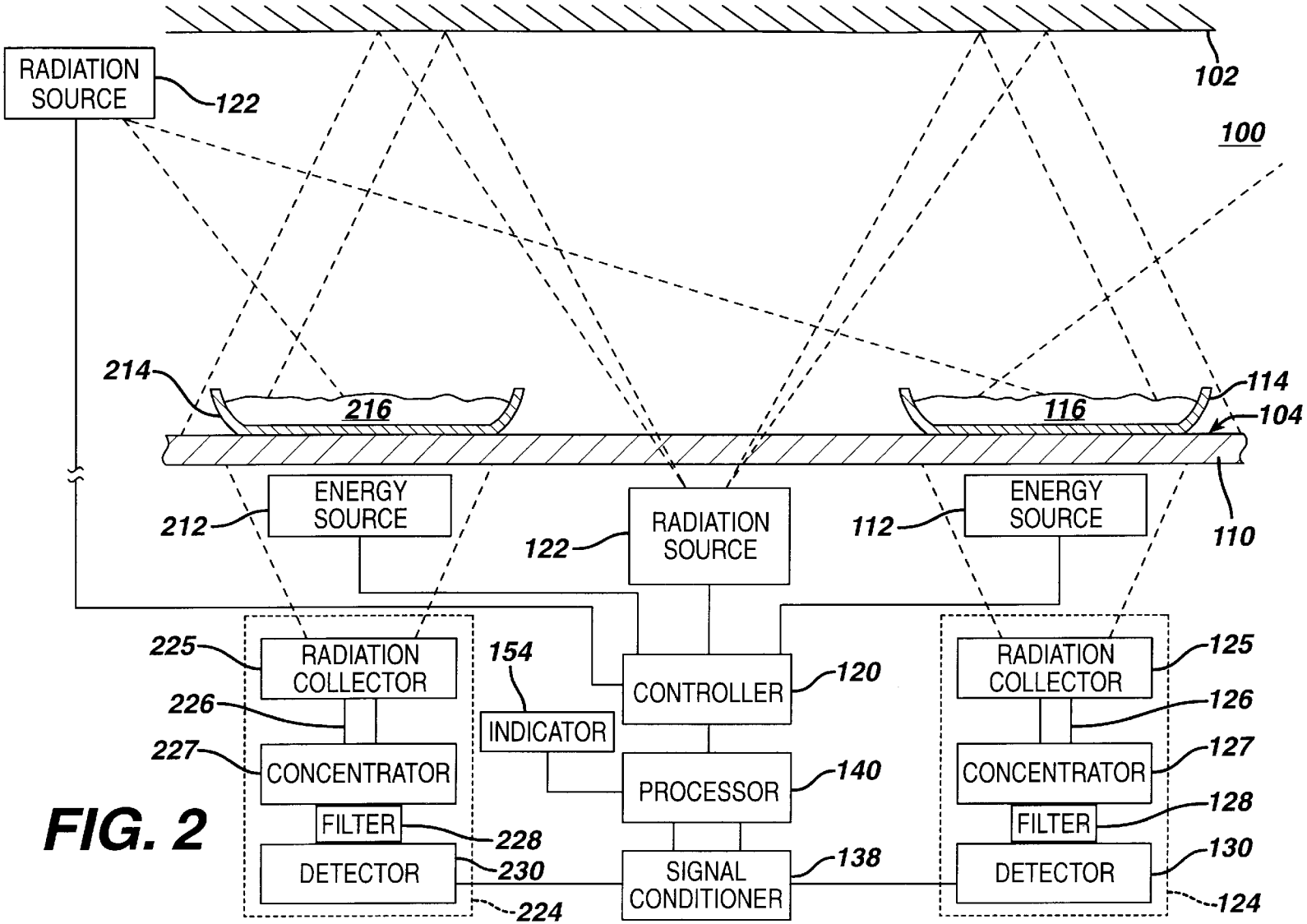

In FIGS. 1 and 2, a monitoring and control system 100 includes a cooktop 104 comprising a cooktop surface 110 positioned below a reflective surface 102. The cooktop surface 110 can be composed of, for example, any suitable solid material, such as glass-ceramic. The reflective surface 102 can, in one embodiment, be composed of any reflective material. In another embodiment, the reflective surface 102 can be any surface that reflects radiation, such as, for example, a ceiling or range hood. In one embodiment, a energy source 112 is positioned below the cooktop surface 110. The energy source 112 can comprise, for example, any suitable energy source, such as radiant heating sources, electric or gas heating elements or induction heating sources. A user can selectively place a vessel 114, such as a pot and/or pan, on the cooktop 110. The vessel 114 contains contents 116 that can be heated by the energy source 112. A controller 120 is connected to the energy source 112 and controls the amount of heat produced by the energy source 112.

Also shown in FIGS. 1 and 2, a radiation source 122 is connected to the controller 120. The radiation source 122 generates and transmits radiation. In one embodiment, the radiation comprises infrared radiation. In another embodiment, the radiation comprises a wavelength ranging from about 700 microns ($\mu$m) and about 1100 microns ($\mu$m). As shown in FIGS. 1 and 2, in one embodiment, the radiation source 122 can be positioned below the cooktop surface 110 and transmit radiation through the cooktop surface 110 toward a reflective surface 102. In another embodiment, the radiation source 122 can be positioned above or flush with the cooktop surface 110 to transmit radiation directly toward the cooktop surface 110 and/or toward the reflective surface 102. Also shown in FIG. 1, in one embodiment, a beam splitter 170 can be connected to or positioned proximate to the radiation source 122 to split the radiation transmitted from the radiation source 122. The beam splitter 170 provides at least two radiation beams where a first radiation beam is directed toward the reflective surface 102 or the cooktop surface 110 and a second radiation beam is directed toward a reference sensor 164. The reference sensor 164 comprises a reference transmission path 176 connected to a reference filter 177, and a reference detector 160 that is connected to the filter 177. Also a reference signal conditioner 178 is connected to the reference detector 160 and the processor 140. The reference signal conditioner 178 receives a reference signal from the reference detector 160, and the reference signal conditioner 178 conditions the reference signal and supplied the reference signal to the processor 140. In one embodiment, the reference signal can be used by the processor 140 to determine properties of the cooktop 104.

A radiation sensor 124 is positioned below the cooktop surface 110 and senses radiation that passes through the cooktop surface 110. The sensed radiation can be transmitted from the radiation source 122 and/or the sensed radiation can be transmitted from a fortuitous radiation source (not shown), such as, for example, a light fixture. In one embodiment, the radiation sensor 124 comprises a radiation collector 125 connected to a transmission path 126 that is connected to a concentrator 127, and a filter 128 is connected to the concentrator 127 and a detector 130. The detector 130 generates radiation signals that are indicative of the amount of radiation collected by the radiation collector 125, and the amount of radiation collected relates to the properties of the cooktop 104. The radiation sensor 124 is connected to a signal conditioner 138 that conditions the radiation signals from the detector 130. The signal conditioner is connected to a processor 140 that is connected to the controller 120. At least one indicator 154 is connected to the processor 140.

In one embodiment, the detector 130 can be temperature compensated. Temperature compensation can be accomplished using a signal indicative of the ambient temperature around detector 130. For example, a temperature sensor (not shown), such as a thermistor, can be used to measure the temperature of the radiation sensor 124 and which, in one embodiment, is connected to software programs in processor 140 using separate channels of an A/D converter (not shown). Alternatively, in another embodiment, temperature compensation is accomplished using a separate hardware implementation.

In even another embodiment, the detector 130 can comprise, for example, a thermal detector, a photon detector, or a quantum detector. In addition, it should be appreciated that the detector 130 can comprise any detectors/sensors (i.e., broadband sensors) that detect or sense radiation emitted by the radiation source 122. In embodiments where the detector 130 comprises a thermal detector, these detectors have a responsive element that is sensitive to temperature resulting from the incident radiation, and an exemplary thermal detector can comprise, for example, a thermopile or a bolometric detector. In other embodiments where the detector 130 comprises a quantum detector or photon detector, these detectors have a responsive element that is sensitive to the number or mobility of free charge carriers, such as electrons and holes, due to the incident infrared photons. For example, a photon detector can comprise types, such as, silicon type, germanium type, and indium-gallium-arsenide (InGaAs) type. In even another embodiment, the detector 130 can comprise a plurality of detectors 130 comprising at least one relatively narrow band quantum detector, such as a silicon or germanium photo-diode. In these embodiments, the plurality of detectors 130 can be used to separate the wavelength sensitivity and increase the specificity and sensitivity of the radiation sensor 124. In addition, the plurality of detectors 130 may comprise detectors 130 that detect different (e.g., two) ranges of wavelength. In one embodiment, regardless of the location of the radiation sensor 124, the radiation source 122 must be activated before the radiation sensor 124 can detect radiation. In alternative embodiments, the radiation sensor 124 is positioned to detect optical radiation affected by the cooking vessel 114 due to ambient light or a separate light source, such as an LED.

The portion of the cooktop surface 110 that contributes to the radiation collected by the radiation collector 125 or that can be "seen" by the radiation collector 125 is termed the field of view. The radiation sensor 124 receives at least a portion of radiation reflected from the reflective surface 102 or fortuitous radiation that passes through the cooktop surface 110. The radiation within the field of view is collected by radiation collector 125 and is supplied to the detector 130 via the transmission path 126, concentrator 127 and filter 128. The filter 128 is used to limit the spectrum of the sensed radiation such that the radiation suitably represents the desired properties of the vessel 114. In particular, the filter 128 can be used to limit the region of wavelengths to those wavelengths for which the cooktop surface 110 is substantially transparent. As a result, the radiation signal produced by the detector 130 can more easily be used to determine the properties of the cooktop 104, such as, for example, the presence, absence and/or other characteristic properties of the vessel 114. Also, the filter 128 can be also utilized to minimize interference caused by reflected radiation from the cooktop surface 110, or ambient light, by limiting the wavelength region to those wavelengths having a minimal reflectivity by the cooktop surface 110.

In one embodiment, the radiation collector 125 can comprises a shape, such as, for example, a frustoconical surface, a paraboloid of revolution, and a compound parabolic concentrator. In another embodiment, the transmission path 126 can comprises a waveguide. In even another embodiment, the transmission path 126 comprises a hollow, tubular configuration having an inner surface that provides infrared radiation reflectivity and low emissivity. In other embodiments, an interior portion (not shown) of the transmission path 126 can comprise a metal providing infrared reflectivity and a low emissivity (e.g., copper and gold). In yet another embodiment, the transmission path 126 comprises a solid material that optically conducts radiation in a selected wavelength range. In these embodiments, materials, such as, for example, glass, $Al_2O_3$ or other suitable infrared transmitting materials.

In FIG. 2, another embodiment of the monitoring and control system 100 includes radiation sensor 124 and second radiation sensor 224 both connected to signal conditioner 138. It should be appreciated that, in one embodiment, the signal conditioner 138 has multiple ports and can process separate signals. In addition, the embodiment shown in FIG. 2 comprises at least two energy sources (energy source 112 and second energy source 212) that are connected to controller 120. In cooktop 104, vessel 114 containing contents 116 is selectively positioned above energy source 112 on the cooktop surface 110, and second vessel 214 containing contents 216 is selectively positioned above second energy source 212 on cooktop surface 110.

As described above, the monitoring and control system 100 of FIG. 2 contains a second radiation sensor 224 that comprises a second radiation collector 225 connected to a second transmission path 226 that is connected to a second concentrator 227. A second filter 228 is included and is connected between the second concentrator 227 and the second detector 230 that is connected to the signal conditioner 138. Similar to FIG. 1, the second radiation sensor 224 senses and detects radiation from the radiation source 122 or radiation from a fortuitous radiation source. The radiation sensed or detected by the second radiation sensor 224 comes from the field of view located around the second heat source 212. The second radiation sensor 224 senses or detects radiation that is reflected by the reflective surface 102 or radiation that is directed toward the cooktop surface 110 by the radiation source 122 or a fortuitous radiation source, such as, for example, ambient light. It should be appreciated that, in one embodiment, the radiation source 122 is positioned between the energy source 112 and the second energy source 212 to transmit radiation the is reflected from the reflective surface 102 wherein at least a portion of the reflected radiation is sensed or detected by radiation sensor 124 and/or radiation sensor 224.

Figure 3:
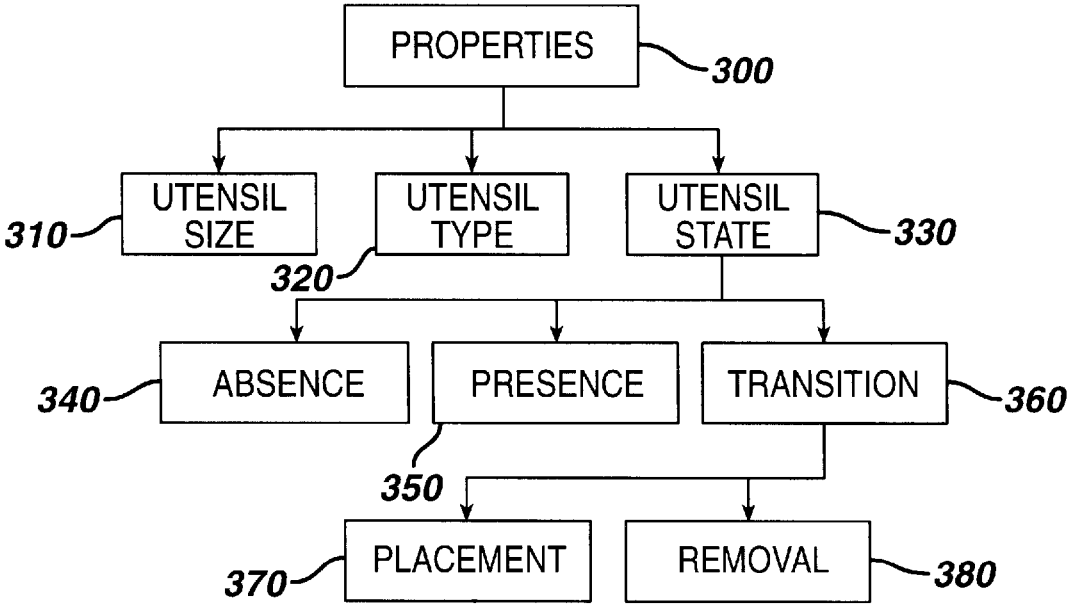
FIG. 3 is a block diagram illustrating exemplary vessel properties and their relationships.
Figure 4:
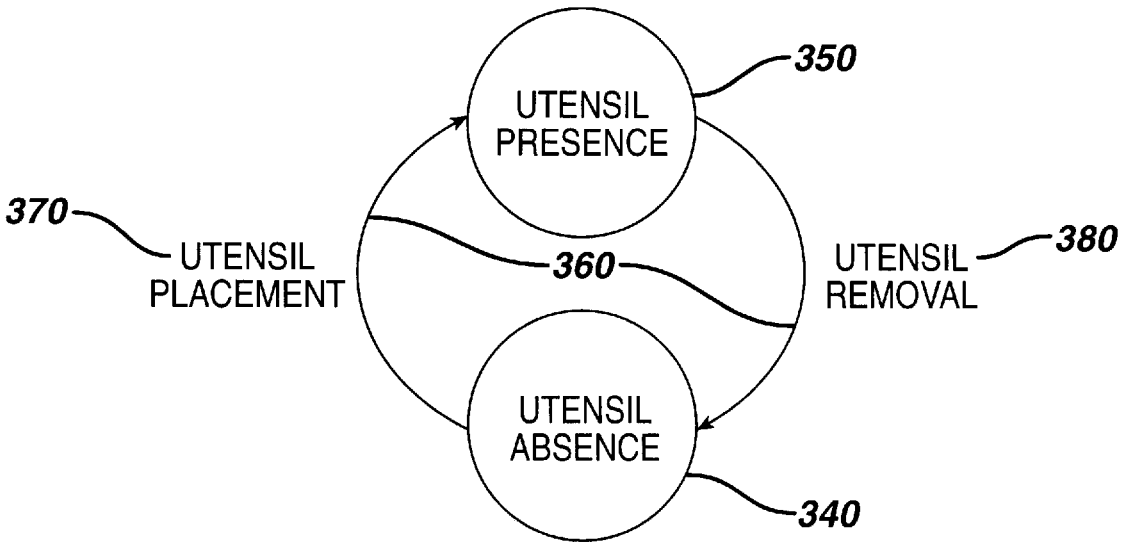
FIG. 4 illustrates the vessel state properties of FIG. 3 in greater detail.

In FIG. 3, vessel properties 300 are defined by detection of radiation affected by the vessel 114. In one embodiment, the vessel properties 300 comprise vessel size 310, vessel type 320, and vessel state 330. The vessel size 310 can comprise the relative size, for example, small or large, among commonly used vessels 114. The vessel type can refer to whether the vessel 114 is dark or shiny. The vessel state 330 can comprise, for example, vessel absence 340, vessel presence 350, and vessel transition 360. In addition, the vessel transition 360 can comprise vessel placement 370 on the cooktop surface 110 or vessel removal 380 from the cooktop surface 110. In FIG. 4, the relationship between a first vessel state (absence state 340) and a second vessel state (presence state 350) associated with the vessel 114 in combination with a cooktop 104. As shown in FIG. 4, a vessel 114 is in either a presence state 350 or an absence state 340 with respect the cooktop surface 110. In addition, the vessel 114 can be transitioning (transition state 360) between the presence state 350 and absence state 340. The transition step 360 comprises, for example, either vessel placement 370 or vessel removal 380.

As described above, ambient lighting affected by the vessel 114 is used to detect at least one property of the cooktop 104, such as, the presence, the absence, and/or the characteristics of a vessel 114 on the cooktop surface 110. The detection is accomplished by using at least one radiation sensor 124 and processor 140 that monitors the change in the radiation signal sensed by the radiation sensor 124. Likewise as described hereinabove, another embodiments includes a radiation source 122, such as an LED, for providing radiation from above or flush with the cooking surface 110. When using a radiation source 122, the properties of the cooktop 104 can be detected by operating the radiation source 122 at a desired frequency, pattern or by modulating radiation emitted by the radiation source 122 such that the radiation is distinguished from ambient radiation or radiation from other sources. In one embodiment, the operation the radiation source 122 at a desired pattern may be accomplished by pulsing the radiation source 122 on and off at a desired frequency. In another embodiment, the radiation from the radiation source 122 can be modulated with signal or pattern. In addition, it should be appreciated that the radiation sensor 124 can be tuned to the desired frequency of operation of the radiation source 122 to facilitate the detection of the properties of the cooktop 104 and/or vessel 114.

As described, the radiation reflected from the reflective surface 102 or that is transmitted directly toward the cooktop surface 110 by the radiation source 122 or another fortuitous radiation source is utilized to determine the size or type of vessel 114 being used on the cooktop surface 110. Such information is used to control the energy source 112 with respect to these specific characteristics of the vessel 114, such as, for example, using only a portion of the energy source 112 to heat a specific area. By using a radiation source 122 separate from the energy source 112, or fortuitous radiation source to provide the radiation, the properties of the cooktop 104 can be determined without having to operate the energy source 112. In addition, the radiation sensed by the radiation sensor 124 is not dependent upon the reflective properties of the vessel 114.

The vessel presence or absence property is monitored by detecting the difference between the reflected radiation from the reflective surface 102 when the vessel 114 is absent from the cooktop surface 110 and the radiation when the vessel 114 is present on the cooktop surface 110. It should be appreciated that the vessel 114 will block radiation from the radiation sensor 124 when the vessel 114 is present on the cooktop surface 110. Therefore, the amount of radiation sensed by the radiation sensor 124 when the vessel 114 is absent from the cooktop surface 110 will be greater than the amount of radiation sensed by the radiation sensor 124 when the vessel 114 is present on the cooktop surface 110.

The vessel 114 placement and removal comprise a transition presence state and absence state of the vessel 114. The transitions are detected by monitoring the changes in the amount of radiation detected by the radiation sensor 124 that is caused by movement of the vessel 114 in relation to the cooktop surface 110. It should be appreciated that, in a first case, the movement of the vessel 114 to a position on the cooktop surface 110 will progressively decrease the amount of radiation sensed by the radiation sensor 124. The decrease in sensed radiation is caused by the vessel 114 that blocks the radiation sensor 124 as the vessel 114 is placed on the cooktop surface 110. In a second case, as the vessel 114 is moved from and/or off the cooktop surface 110 the amount of radiation sensed by the radiation sensor 124 will progressively increase. As such, the radiation that is sensed by the radiation sensor 124 can be distinguished from sudden or much slower changes in ambient light. The vessel 114 causes the increase when moved from the cooktop surface 110 because the vessel 114 does not block radiation from being sensed by the radiation sensor 124. As such, during detection of vessel 114 placement or removal, the processor 140 can analyze the radiation signal produced from the detector 130 by performing at least one derivative on the radiation signal.

The detection of the size of the vessel 114 can be used to control the size of the energy source 112 that is used to heat the vessel 114, and thus decrease the amount of time required to heat the vessel 114. In one embodiment, the energy source 112 comprises a burner having an inner burner and an annular burner. For a vessel 114 covering a small amount of cooktop surface area, the inner burner can be used to heat the vessel 114. For vessels 114 covering a large amount of cooktop surface area, the inner burner and the annular burner can be used to heat the vessel 114. The detection of the size of the vessel 114 can be controlled in one representative embodiment, by the field of view of the radiation sensor 124. In one embodiment, radiation is detected with a vessel 114 absent from the cooktop surface 110. The size of the vessel 114 can be detected by sensing an amount of radiation detected when the vessel 114 is present on the cooktop surface 110. The comparison of the vessel-absent radiation to the vessel-present radiation can be used to identify the vessel 114 size or type. In one embodiment, when the vessel-present radiation divided by the vessel-absent radiation is a large percentage, the vessel 114 is small because the vessel 114 is allowing a high percentage of the radiation to be sensed by the radiation sensor 124 when the vessel 114 is present on the cooktop surface 110. In another embodiment, when the vessel-present radiation divided by the vessel-absent radiation is a small percentage, the vessel 114 is large because the vessel 114 is allowing a smaller percentage of the radiation to be sensed by the radiation sensor 124 when the vessel 114 is placed on the cooktop surface 110. It should be appreciated that in one embodiment the monitoring control system 100 can be preprogrammed or calibrated in the processor 140 with the amount or percentage of sensed radiation that corresponds with a particular size or type of vessel 114 and/or other properties of the cooktop 104 and their relation to the amount of radiation sensed by the radiation sensor 124. It should also be appreciated that in another embodiment a user or installation personnel can program the processor 140 with the amount of sensed radiation that corresponds with a particular size or type of vessel 114 and/or other properties of the cooktop 104 and their relation to the amount of radiation sensed by the radiation sensor 124.

The foregoing discussion of the invention has been presented for purposes of illustration and description. Further, the description is not intended to limit the invention to the form disclosed herein. Consequently, variations and modifications commensurate with the above teachings, with the skill and knowledge of the relevant art, are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A method for determining properties of a cooktop having a cooktop surface and a vessel selectively placed on the cooktop surface, the method comprising the steps of:

providing radiation to an area above the cooktop surface;

directing at least a portion of the provided radiation toward the cooktop surface;

detecting a portion of the directed radiation passing through the cooktop surface; and determining properties of the cooktop from the detected radiation.

2. The method of claim 1 wherein the properties of the cooktop are selected from the group consisting of: absence of the vessel from the cooktop surface, presence of the vessel on the cooktop surface, removal of the vessel from the cooktop surface, placement of a vessel on the cooktop surface and determination of a size of the vessel on the cooktop surface.

3. The method of claim 1 wherein the step of providing radiation to an area above the cooktop surface provides radiation at a predetermined frequency.

4. The method of claim 1 wherein the step of providing radiation to an area above the cooktop surface modulates the radiation.

5. The method of claim 1 wherein the step of providing radiation above the cooktop surface comprises:

generating radiation at a position below the cooktop surface; and transmitting the generated radiation through the cooktop surface to a position above the cooktop surface.

6. The method of claim 5 wherein the step of transmitting comprises:

splitting the generated radiation into at least a first beam of radiation and a second beam of radiation; and the step of transmitting comprising the steps of:

directing the first beam of radiation through and above the cooktop surface; and directing the second beam of radiation to a reference detector generating a reference radiation signal.

7. The method of claim 6 wherein the step of determining properties of the cooktop comprises comparing a detected radiation signal generated from the detected radiation with the reference radiation signal.

8. The method of claim 1 wherein the step of directing the radiation toward the cooktop surface comprises reflecting at least a portion of the provided radiation toward the cooktop surface using a reflective member.

9. The method of claim 1 wherein the radiation comprises infrared radiation.

10. The method of claim 1 wherein the radiation comprises a wavelength ranging from about 700 microns to about 1100 microns.

11. A method for detecting properties of a cooktop having a cooktop surface and a vessel selectively placed on the cooktop surface, the method comprising the steps of:

generating radiation at a position below the cooktop surface;

transmitting the generated radiation through the cooktop surface to a position above the cooktop surface;

reflecting at least a portion of the transmitted radiation toward the cooktop surface using a reflective member;

detecting a portion of the reflected radiation passing through the cooktop surface; and determining properties of the cooktop from the detected radiation.

12. The method of claim 10 wherein the properties of the cooktop are selected from the group consisting of: absence of the vessel from the cooktop surface, presence of the vessel on the cooktop surface, removal of the vessel from the cooktop surface, placement of the vessel on the cooktop surface and determination of a size of the vessel on the cooktop surface.

13. The method of claim 11 wherein the step of transmitting comprises transmitting the generated radiation through the cooktop surface at a predetermined frequency.

14. The method of claim 11 wherein the step of transmitting comprises transmitting the generated radiation through the cooktop via modulating the radiation.

15. The method of claim 11 further comprising the steps of:

focusing the reflected radiation passing through the cooktop surface using a radiation collector; and directing the focused radiation to a radiation detector.

16. The method of claim 11 further comprising filtering the reflected radiation passing through the cooktop surface.

17. The method of claim 11 further comprising the steps of:

splitting the generated radiation into at least a first beam of radiation and a second beam of radiation; and the step of transmitting comprising the steps of:

directing the first beam of radiation through and above the cooktop surface; and directing the second beam of radiation to a reference detector generating a reference radiation signal.

18. The method of claim 17 wherein the step of determining properties of the cooktop comprises comparing a detected radiation signal generated from the detected radiation with the reference radiation signal.

19. The method of claim 11 wherein the radiation comprises infrared radiation.

20. The method of claim 11 wherein the radiation comprises a wavelength ranging from about 700 microns to about 1100 microns.

21. An apparatus for determining properties of a cooktop having a cooktop surface and a vessel selectively placed on the cooktop surface, the apparatus comprising:

a radiation sensor positioned below the cooktop surface for sensing at least a portion of, at least one of reflected radiation and ambient radiation provided above the cooktop surface and passing through the cooktop surface and generating a detected radiation signal based on the sensed radiation; and a processor connected to the radiation sensor for determining properties of the cooktop from analyzing the detected radiation signal.

22. The apparatus of claim 21 wherein the properties of the cooktop are selected from the group consisting of: absence of the vessel from the cooktop surface, presence of the vessel on the cooktop surface, removal of the vessel from the cooktop surface, placement of the vessel on the cooktop surface and determination of a size of the vessel on the cooktop surface.

23. The apparatus of claim 21 wherein the radiation sensor comprises:

a radiation collector positioned below the cooktop surface for collecting the at least a portion of, the at least one of the reflected radiation and the ambient radiation;

a transmission path connected to the radiation collector for transmitting the collected radiation;

a concentrator connected to the transmission path for concentrating the transmitted radiation;

a filter connected to the concentrator for filtering the concentrated radiation; and a detector connected to the filter for detecting the filtered radiation and generating the detected radiation signal from the detected radiation.

24. The apparatus of claim 21 further comprising:

a signal conditioner connected to the radiation sensor for conditioning the detected radiation signal; and a controller connected to the processor.

25. The apparatus of claim 21 further comprising an indicator connected to the processor for indicating at least one of the properties of the cooktop determined by the processor.

26. The apparatus of claim 21 wherein the cooktop surface comprises a glass ceramic material.

27. The apparatus of claim 21 wherein the radiation comprises infrared radiation.

28. The apparatus of claim 21 wherein the radiation comprises a wavelength ranging from about 700 microns to about 1100 microns.

29. The apparatus of claim 21 wherein the radiation sensor senses the at least a portion of, the at least one of reflected radiation and ambient radiation provided at a predetermined frequency.

30. An apparatus for determining properties of a cooktop having a cooktop surface and a vessel selectively placed on the cooktop surface, the apparatus comprising:

a radiation source positioned below the cooktop surface for generating radiation and transmitting the radiation through the cooktop surface to a position above the cooktop surface;

a reflective surface positioned above the cooktop surface for reflecting at least a portion of the transmitted radiation;

a radiation sensor positioned below the cooktop surface for sensing at least a portion of the reflected radiation passing through the cooktop surface and generating a detected radiation signal in response to the sensed radiation; and a processor connected to the radiation sensor and receiving the detected radiation signal wherein the processor determines properties of the cooktop from analyzing the detected radiation signal.

31. The apparatus of claim 30 wherein the properties of the cooktop are selected from the group consisting of: absence of the vessel from the cooktop surface, presence of the vessel on the cooktop surface, removal of the vessel from the cooktop surface, placement of the vessel on the cooktop surface, a determination of a size of the vessel on the cooktop surface.

32. The apparatus of claim 30 wherein the radiation sensor comprises:

a radiation collector positioned below the cooktop surface for collecting the at least a portion of the reflected radiation;

a transmission path connected to the radiation collector for transmitting the collected radiation;

a concentrator connected to the transmission path for concentrating the transmitted radiation;

a filter connected to the concentrator for filtering the concentrated radiation; and a detector connected to the filter for detecting the filtered radiation and generating the detected radiation signal from the detected radiation.

33. The apparatus of claim 30 further comprising:

a signal conditioner connected to the radiation sensor for conditioning the detected radiation signal; and a controller connected to the processor and the radiation source.

34. The apparatus of claim 30 further comprising an indicator connected to the processor for indicating at least one of the properties of the cooktop determined by the processor.

35. The apparatus of claim 30 wherein the cooktop surface comprises a glass ceramic material.

36. The apparatus of claim 30 wherein the radiation comprises infrared radiation.

37. The apparatus of claim 30 wherein the radiation comprises a wavelength ranging from about 700 microns to about 1100 microns.

38. The apparatus of claim 30 further comprising a beam splitter connected to the radiation source for splitting the radiation into at least a first beam of radiation and a second beam of radiation.

39. The apparatus of claim 38 further comprising a reference detector connected to the processor wherein the first beam of radiation is transmitted through and above the cooktop surface and the second beam of radiation is transmitted toward the reference detector generating a reference radiation signal in response to radiation transmitted to the reference detector.

40. The apparatus of claim 39 wherein at least one of the properties of the cooktop is determined by the processor comparing the reference radiation signal to the detected radiation signal.

41. The apparatus of claim 40 further comprising:

a transmission path connected to the beam splitter;

a filter connected to the transmission path and the reference detector for filtering the transmitted signal; and a signal conditioner connected to the reference detector and the processor for conditioning the reference radiation signal.

* * * * *